US008346120B2

(12) United States Patent
Saito et al.

(10) Patent No.: US 8,346,120 B2
(45) Date of Patent: Jan. 1, 2013

(54) IMAGE FORMING APPARATUS THAT INCLUDES A MEDIUM CONVEYANCE UNIT, AN IMAGE RECORDING UNIT, AND RECORDING UNIT SUPPORT PORTIONS

(75) Inventors: Yasuhide Saito, Saitama (JP); Naomasa Okimura, Saitama (JP); Shin Komatsu, Saitama (JP); Ryotaro Nomi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 461 days.

(21) Appl. No.: 12/688,431

(22) Filed: Jan. 15, 2010

(65) Prior Publication Data

US 2010/0278556 A1 Nov. 4, 2010

(30) Foreign Application Priority Data

Apr. 30, 2009 (JP) ..... 2009-111625

(51) Int. Cl.
*G03G 15/00* (2006.01)
*G03G 15/16* (2006.01)
*G03G 15/20* (2006.01)

(52) U.S. Cl. ..... 399/107; 399/110; 399/121; 399/122

(58) Field of Classification Search ..... 399/107, 399/110, 121, 122, 124
See application file for complete search history.

(56) References Cited

U.S. PATENT DOCUMENTS

| | | | | |
|---|---|---|---|---|
| 7,555,238 | B2 * | 6/2009 | Igarashi | 399/121 |
| 7,620,344 | B2 * | 11/2009 | Igarashi | 399/110 |
| 8,010,013 | B2 * | 8/2011 | Tomatsu | 399/110 |

FOREIGN PATENT DOCUMENTS

| | | | |
|---|---|---|---|
| JP | 08-156366 | A | 6/1996 |
| JP | 10-104998 | A | 4/1998 |
| JP | 10-194506 | A | 7/1998 |
| JP | 2000-310930 | A | 11/2000 |
| JP | 2003-186372 | A | 7/2003 |
| JP | 2007-226007 | A | 9/2007 |

OTHER PUBLICATIONS

Australian Office Action issued Apr. 13, 2011, in corresponding Australian Application No. 2010200566.

* cited by examiner

*Primary Examiner* — William J Royer
(74) *Attorney, Agent, or Firm* — Sughrue Mion, PLLC

(57) ABSTRACT

An image forming apparatus includes: a medium conveyance unit; an image recording unit; and recording unit support portions. The image recording unit is supported by the medium conveyance unit in an undetachable manner for a user who uses the image forming apparatus. The recording unit support portions have a first support portion and a second support portion which are disposed in the image recording unit on a side of an outlet and are spaced from each other in a width direction of a medium conveyed, and a third support portion which is disposed in the image recording unit on an opposite side to the outlet. At least the first support portion and the second support portion are supported on the side of the outlet of the medium conveyance unit.

11 Claims, 13 Drawing Sheets

IMAGE FORMING APPARATUS THAT INCLUDES A MEDIUM CONVEYANCE UNIT, AN IMAGE RECORDING UNIT, AND RECORDING UNIT SUPPORT PORTIONS

CROSS-REFERENCE TO RELATED APPLICATIONS

This application is based on and claims priority under 35 USC 119 from Japanese Patent Application No. 2009-111625 filed on Apr. 30, 2009.

BACKGROUND

Technical Field

The present invention relates to an image forming apparatus.

SUMMARY

According to an aspect of the invention, an image forming apparatus includes: a medium conveyance unit that includes medium conveying members which convey a medium on which an image is to be recorded and an outlet from which the medium is output; an image recording unit that includes an image recording device which records the image on the medium conveyed from the medium conveyance unit at an image recording region which is located on a side of the outlet; and recording unit support portions that have a first support portion and a second support portion which are disposed in the image recording unit on the side of the outlet and are spaced from each other in a width direction of the medium conveyed, and a third support portion which is disposed in the image recording unit on an opposite side to the outlet. At least the first support portion and the second support portion are supported on the side of the outlet of the medium conveyance unit, and the image recording unit is supported by the medium conveyance unit in an undetachable manner for a user who uses the medium.

BRIEF DESCRIPTION OF THE DRAWINGS

Exemplary embodiment(s) of the present invention will be described in detail based on the following figures, wherein:

FIG. 5A illustrates an intermediate state of attachment of a support subject portion of a fusing unit to the fusing unit support portion and FIG. 5B illustrates a state that the attachment has been completed;

DETAILED DESCRIPTION

Figure 1:
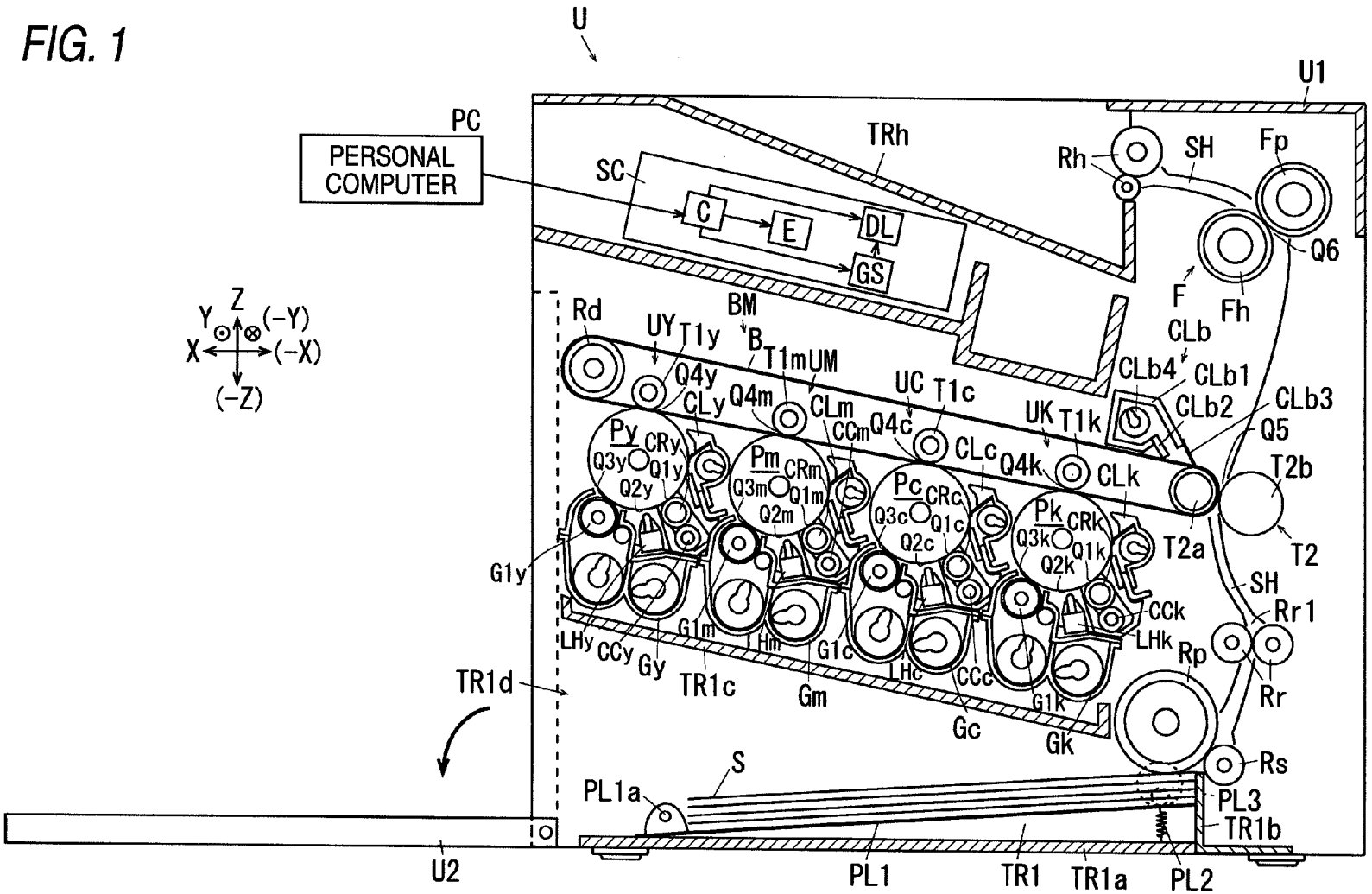
FIG. 1 illustrates the whole of an image forming apparatus according to a first exemplary embodiment of the present invention.

An exemplary embodiment of the present invention will be hereinafter described with reference to the drawings. However, the invention is not limited to the following exemplary embodiment.

To facilitate understanding of the following description, in the drawings, the X-axis direction, the Y-axis direction, and the Z-axis direction are defined as the front-rear direction, the right-left direction, and the top-bottom direction, respectively and the directions or sides indicated by arrows X, −X, Y, −Y, and Z, and −Z are defined as the front direction or side, the rear direction or side, the right direction or side, the left direction or side, the top direction or side, and the bottom direction or side, respectively.

In the drawings, a circle "○" having a dot "•" inside means an arrow that is directed from the back side to the front side of the paper surface and a circle "○" having a cross "×" inside means an arrow that is directed from the front side to the back side of the paper surface.

Furthermore, in the drawings, to facilitate understanding, members that are not indispensable for a description may be omitted as appropriate.

FIG. 1 illustrates the whole of an image forming apparatus according to a first exemplary embodiment of the invention.

As shown in FIG. 1, an ejection tray TRh may be used for a sheet S (example medium). The ejection tray TRh constitutes a top end portion of a printer U which is the image forming apparatus according to the first exemplary embodiment of the invention. A control board SC in which various control circuits, storage devices, and the like are arranged is disposed under the ejection tray TRh. The control board SC is provided with a control circuit C for performing various controls of the printer U, an image processing section GS, a latent image forming device drive circuit DL, and a power circuit E (example power device) whose operations are controlled by the control board SC, and other circuits. The power circuit E applies voltages to charging rollers CRy-CRk (example chargers; described later), developing rollers G1*y*-G1*k* (example developer holding bodies), transfer rollers T1*y*-T1*k* (example transfer devices), and the like.

The image processing section GS converts print information that is input from a personal computer PC (example external image information sending apparatus) or the like into pieces of latent image forming image information corresponding to four colors which are yellow (Y), magenta (M), cyan (C), and black (K) and outputs them to the latent image forming device drive circuit DL with prescribed timing.

Where a document image is a black-and-white image, only image information of black is input to the latent image forming device drive circuit DL.

Having drive circuits of the respective colors Y, M, C, and K, the latent image forming device drive circuit DL outputs signals corresponding to the received pieces of image information with prescribed timing to LED heads LHy, LHm, LHc, and LHk (example latent image forming devices) provided for the respective colors.

Visible image forming devices UY, UM, UC, and UK for forming toner images (example visible images) of the respective colors Y, M, C, and K are disposed and occupy a bottom-center space of the printer U. As shown in FIG. 1, the visible image forming device UK of black (K) has a photoreceptor body Pk (example image holding body) which is rotated. The charging roller CRk (example charger) for charging the surface of the photoreceptor body Pk, the LED head LHk (example latent image forming device) for forming an electrostatic latent image on the surface of the photoreceptor body Pk, a photoreceptor body cleaner CLk (example image carrying body cleaner) for removing developer that remains on the surface of the photoreceptor body Pk, and the like are disposed around the photoreceptor body Pk.

The visible image forming devices UY, UM, and UC of the other colors are configured in the same manner as the visible image forming device UK of black.

After the surfaces of the photoreceptor bodies Py-Pk are charged uniformly by the charging rollers CRy-CRk at charging regions Q1*y*, Q1*m*, Q1*c*, and Q1*k* where the photoreceptor bodies Py-Pk are opposed to the charging rollers CRy-CRk, latent images are written to the surfaces of the photoreceptor bodies Py-Pk by the LED heads LHy-LHk at latent image forming regions Q2*y*, Q2*m*, Q2*c*, and Q2*k*. The electrostatic latent images thus written are developed into toner images at developing regions Q3*y*, Q3*m*, Q3*c*, and Q3*k* where the photoreceptor bodies Py-Pk are opposed to development devices Gy-Gk. The toner images thus formed are conveyed to primary transfer regions Q4*y*, Q4*m*, Q4*c*, and Q4*k* where the photoreceptor bodies Py-Pk are in contact with an intermediate transfer belt B (example intermediate transfer body). In the first exemplary embodiment, the intermediate transfer belt B is an endless belt member and is rotatably supported by an intermediate transfer support system consisting of a belt drive roller Rd (example drive member), a backup roller T2*a* (example follower member, example secondary transfer counter member), and the primary transfer rollers T1*y*, T1*m*, T1*c*, and T1*k* which are opposed to the photoreceptor bodies Py-Pk. The intermediate transfer body is not limited to belt-shaped ones and may have any of known shapes such as a drum shape.

Primary transfer voltages whose polarity is opposite to the toner charging polarity are applied to the primary transfer rollers T1*y*, T1*m*, T1*c*, and T1*k* (example primary transfer devices) which are disposed on the back side of the intermediate transfer belt B, with preset timing at the primary transfer regions Q4*y*, Q4*m*, Q4*c*, and Q4*k* from the power circuit E which is controlled by the control circuit C. As a result, the toner images on the photoreceptor bodies Py-Pk are transferred primarily to the intermediate transfer belt B by the primary transfer rollers T1*y*, T1*m*, T1*c*, and T1*k*.

Residual substances and stuck substances such as transfer-residual toners that remain on the surfaces of the photoreceptor bodies Py-Pk after the primary transfer and discharge products are removed by the photoreceptor body cleaners CLy, CLm, CLc, and CLk. The cleaned-up surfaces of the photoreceptor bodies Py-Pk are charged again by the charging rollers CRy, CRm, CRc, and CRk. Residual substances and the like that have not been removed by the photoreceptor body cleaners CLy-CLk and have been stuck to the charging rollers CRy-CRk are removed by charger cleaners CCy, CCm, CCc, and CCk (example charger cleaning members) which are disposed so as to be in contact with the charging rollers CRy-CRk.

A belt cleaner CLb (example intermediate transfer body cleaner) is disposed above a rear end portion of the intermediate transfer belt B. The belt cleaner CLb is equipped with a cleaning container CLb1, a belt cleaning blade CLb2 (example cleaning member) which is supported by the cleaning container CLb1 and serves to remove substances remaining on the surface of the intermediate transfer belt B by contacting it, a film CLb3 (example leakage preventing member) for preventing scattering and leakage of residual substances removed by the belt cleaning blade CLb2, and a residual substance conveying member CLb4 which is disposed inside the cleaning container CLb1 and serves to convey and discharge removed residual substances. The cleaning container CLb1 of the first exemplary embodiment is disposed over the photoreceptor body cleaner CLk of black.

A secondary transfer roller T2*b* (example secondary transfer member) is opposed to the backup roller T2*a* with the intermediate transfer belt B interposed in between. The backup roller T2*a* and the secondary transfer roller T2*b* constitute a secondary transfer device T2 of the first exemplary embodiment. The region where the secondary transfer device T2 is opposed to the intermediate transfer belt B is a secondary transfer region Q5 (example image recording region).

The multi-color toner images (or black-and-white toner image) that have been transferred to the intermediate transfer belt B sequentially in superimposition by the primary transfer rollers T1*y*, T1*m*, T1*c*, and T1*k* at the primary transfer regions Q4*y*, Q4*m*, Q4*c*, and Q4*k* are conveyed to the secondary transfer region Q5.

An image recording device UY-UK+B is composed of the visible image forming devices UY-UK, and the intermediate transfer belt B.

A transfer device (T1*y*-T1*k*)+T2+B of the first exemplary embodiment is composed of the primary transfer rollers T1*y*-T1*k*, the intermediate transfer belt B, and the secondary transfer device T2.

As shown in FIG. 1, the intermediate transfer belt B of the first exemplary embodiment is inclined from the horizontal plane in such a manner that the primary transfer regions Q4*y*-Q4*k* go down as the position goes rearward. Accordingly, the visible image forming devices UY-UK are disposed so as to go down as the position goes downstream in the belt conveying direction.

A sheet supply tray TR1 (example medium containing unit) is disposed under the visible image forming devices UY-UK. The sheet supply tray TR1 is equipped with a bottom wall TR1*a*, a rear end wall TR1*b* which extends upward from the rear end of the bottom wall TR1*a*, and a top wall TR1*c* which is disposed over and opposed to the bottom wall TR1*a*. A replenishment space TR1*d* through which to supply new recording sheets S occupies a front portion of the sheet supply tray TR1. The top wall TR1*c* is inclined so as to go up as the position comes closer to the outside of the replenishment space TR1*d*, that is, goes forward. Therefore, the gap between the top wall TR1*c* and the bottom wall TR1*a*, that is, the height of the replenishment space TR1*d*, increases as the position goes forward.

An elevation plate PL1 (example medium placement member) for elevating and lowering sheets S placed thereon is disposed over and supported by the bottom wall TR1*a* so as to be rotatable about a rotation center PL1*a*. An elevation spring PL2 (example urging member) for urging a rear end portion of the elevation plate PL1 upward is disposed adjacent to the rear end portion of the elevation plate PL1. When image formation is not performed, the elevation plate PL1 is moved to a bottom position where it is parallel with the bottom wall TR1*a* by eccentric-cam-shaped push-down members PL3 which are disposed at left and right ends. During image formation, the push-down members PL3 are disengaged by rotation and the elevation plate PL1 is supported so as to be movable between the bottom position and a top position shown in FIG. 1 being urged by the elevation spring PL2.

Therefore, when a replenishment space cover U2 (example replenishment space opening/closing member) is opened, the replenishment space TR1*d* is made accessible and new recording sheets S are inserted until reaching the rear end wall TR1*b* and housed in the sheet supply tray TR1 (placed on the elevation plate PL1 which is located at the bottom position).

A sheet feed roller Rp (example medium conveying member, example sending member) is disposed behind the top wall TR1*c*. The sheet feed roller Rp is disposed at such a position that the top one of the recording sheets S placed on the elevation plate PL1 is pressed against it by the restoring force of the elevation spring PL2 in a state that the elevation plate PL1 is located at the top position. A retard roller Rs (example separating member) is disposed above the rear end wall TR1*b*.

Recording sheets S are sent out from the sheet supply tray TR1 by the sheet feed roller Rp, separated into individual recording sheets S at the contact region of the retard roller Rs and the sheet feed roller Rp, and conveyed to a medium conveyance path SH one by one. The recording sheet S is conveyed along the medium conveyance path SH to registration rollers Rr (example medium conveying members, example timing adjusting members) for adjusting conveyance start timing of the recording sheet S. The recording sheet S that has been conveyed to the registration rollers Rr is sent out from an outlet Rr1 of the registration rollers Rr toward the secondary transfer region Q5 with such timing that the toner images on the intermediate transfer belt B reach the secondary transfer region Q5.

The intermediate transfer belt B from which the toner images have been transferred at the secondary transfer region Q5 is cleaned, that is, residual substances such as transfer-residual toners and discharge products that remain on the surface of the intermediate transfer belt B are removed by the belt cleaner CLb.

The recording sheet S to which the toner images have been transferred is conveyed to a fusing region Q6 of a fusing device F. The fusing device F is equipped with a heating roller Fh (example heat fusing member) and a pressing roller Fp (example pressure fusing member). The fusing region Q6 is a region where the heating roller Fh and the pressing roller Fp are in contact with each other at preset pressure. The unfused toner images on the recording sheet S are fused by heat and pressure as it passes the fusing region Q6.

The recording sheet S to which the images toner have been fused is conveyed along the medium conveyance path SH and ejected to the ejection tray TRh from ejection rollers Rh (example medium ejecting members).

Figure 2:
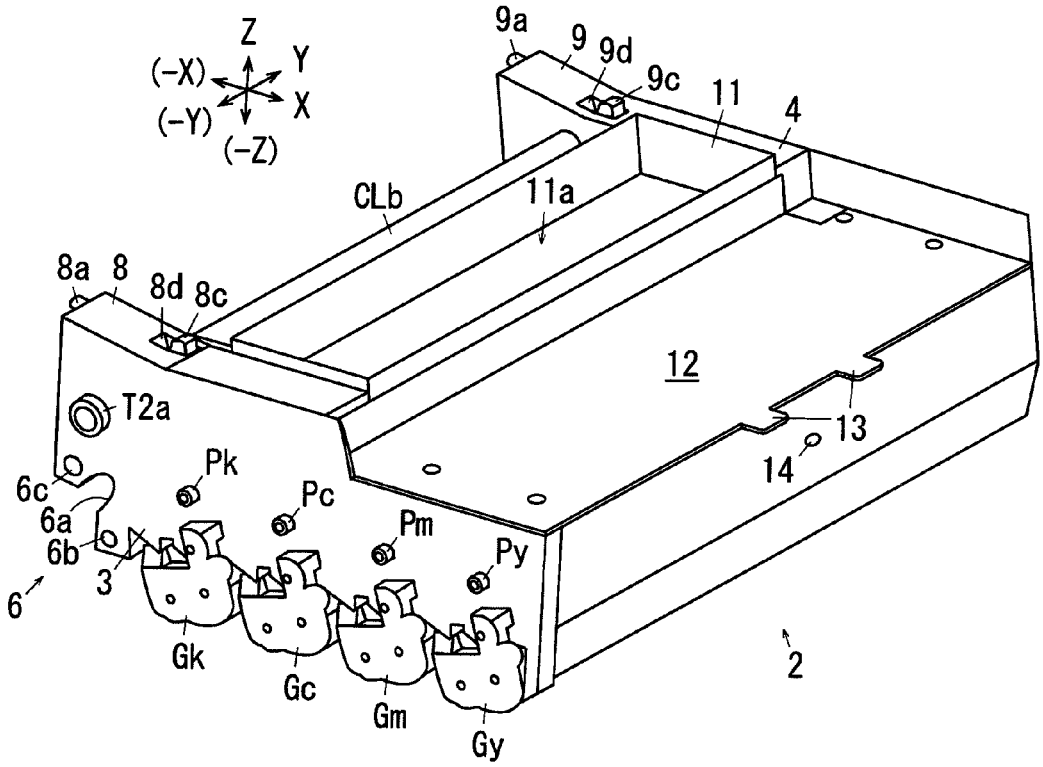
FIG. 2 shows an important part of a recording unit main body of an image recording unit of the first exemplary embodiment.
Figure 3:
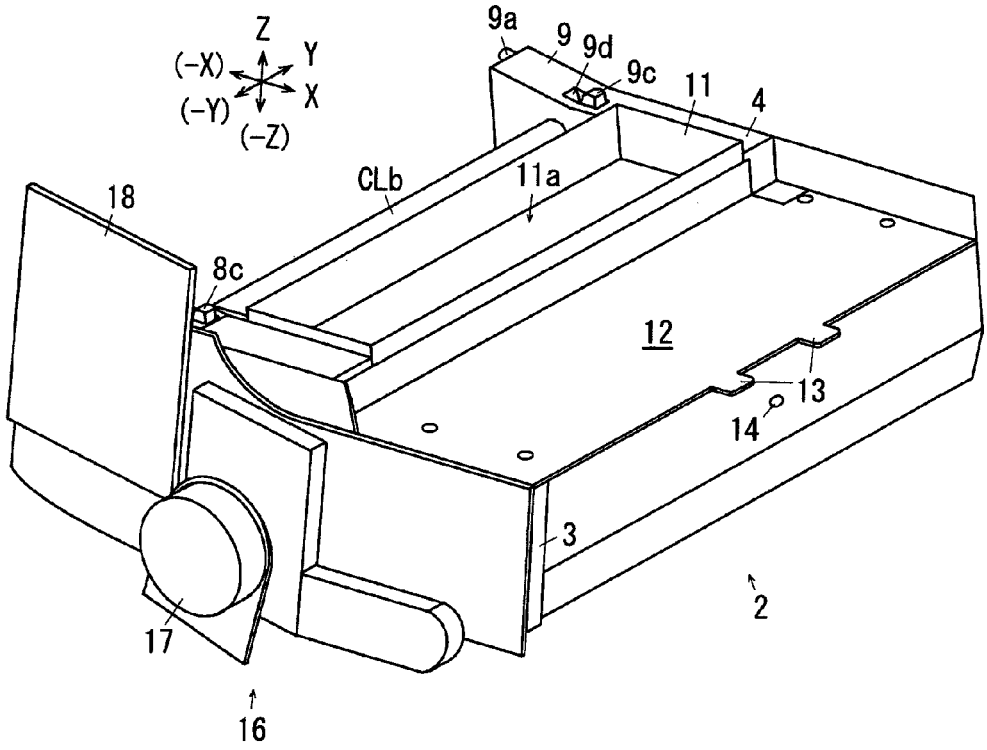
FIG. 3 shows the recording unit main body of FIG. 2 and a drive unit attached to it.
Figure 4:
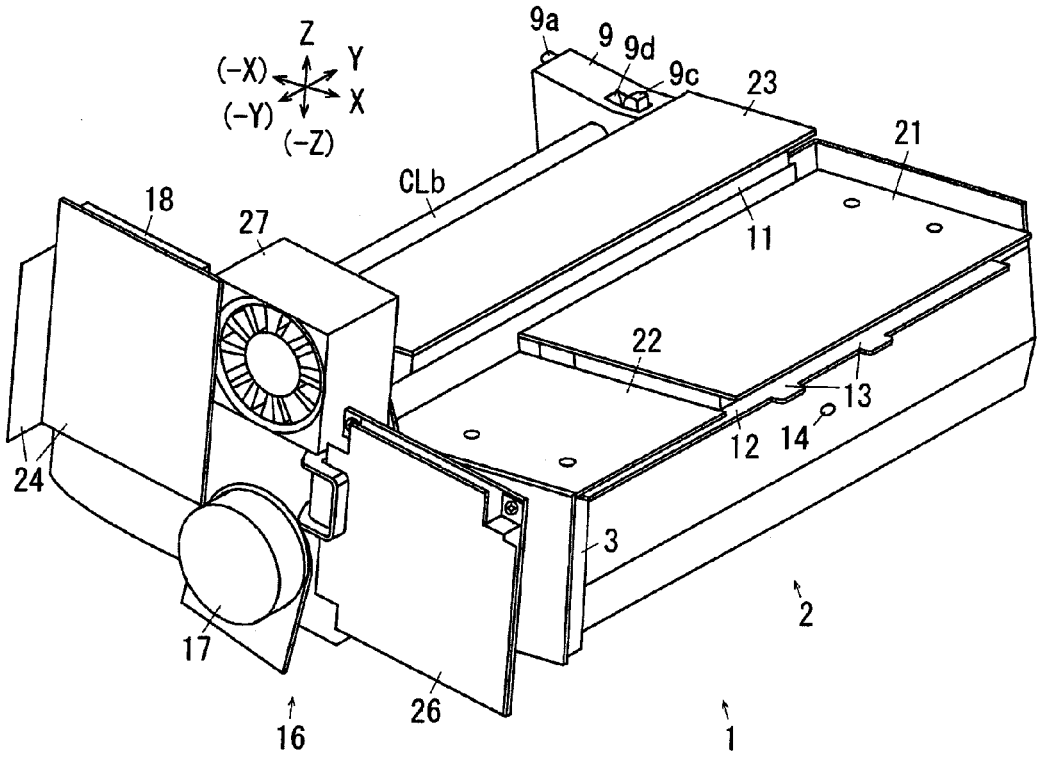
FIG. 4 shows the assembly of FIG. 3 and a circuit board attached to it.
Figure 5A:
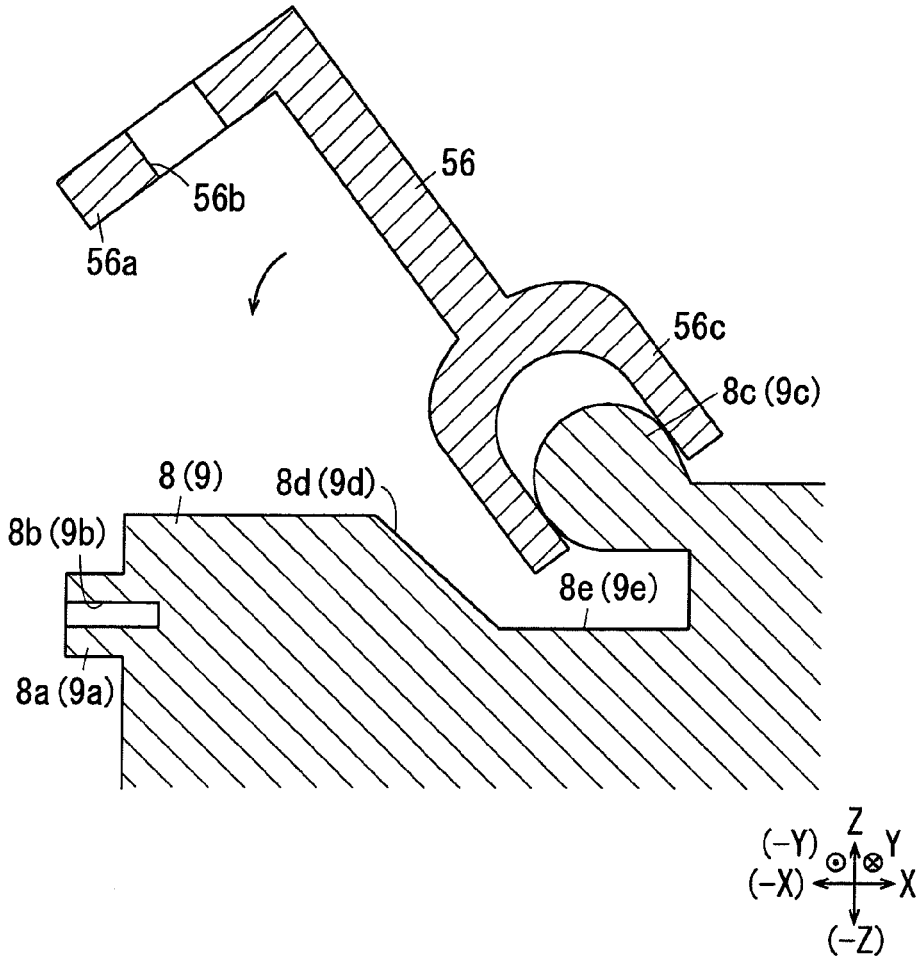
FIGS. 5A and 5B are enlarged views of an important part including a fusing unit support portion.
Figure 5B:
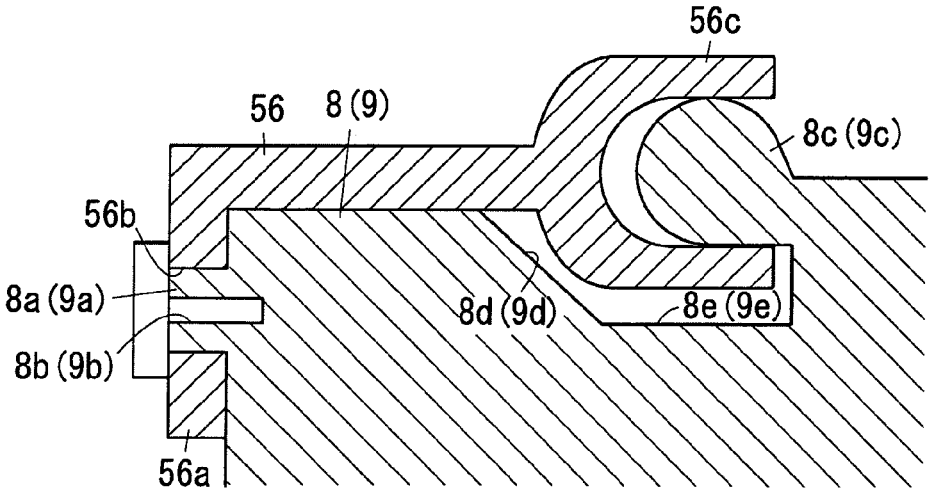
Figure 6:
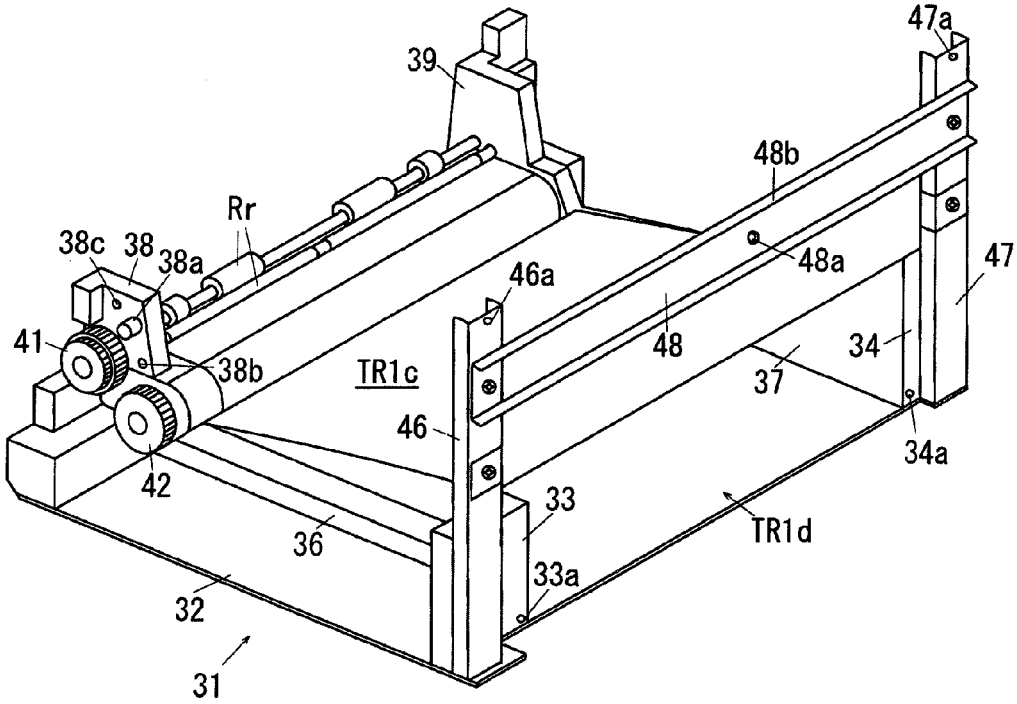
FIG. 6 is a perspective view showing an important part of a medium conveyance unit (example second unit) of the exemplary embodiment.
Figure 7:
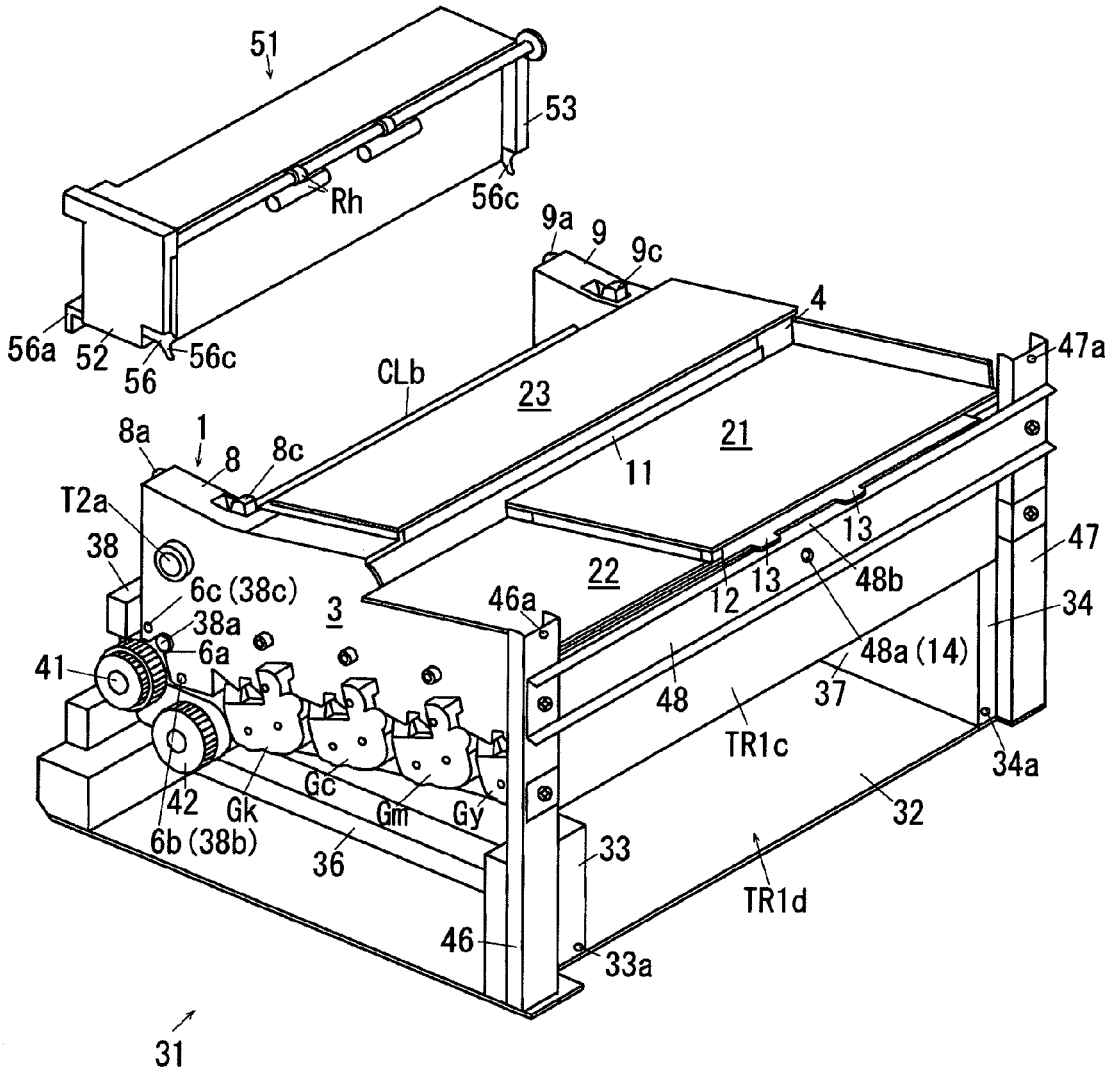
FIG. 7 shows a state that the medium conveyance unit and the image recording unit are connected to each other.
Figure 8:
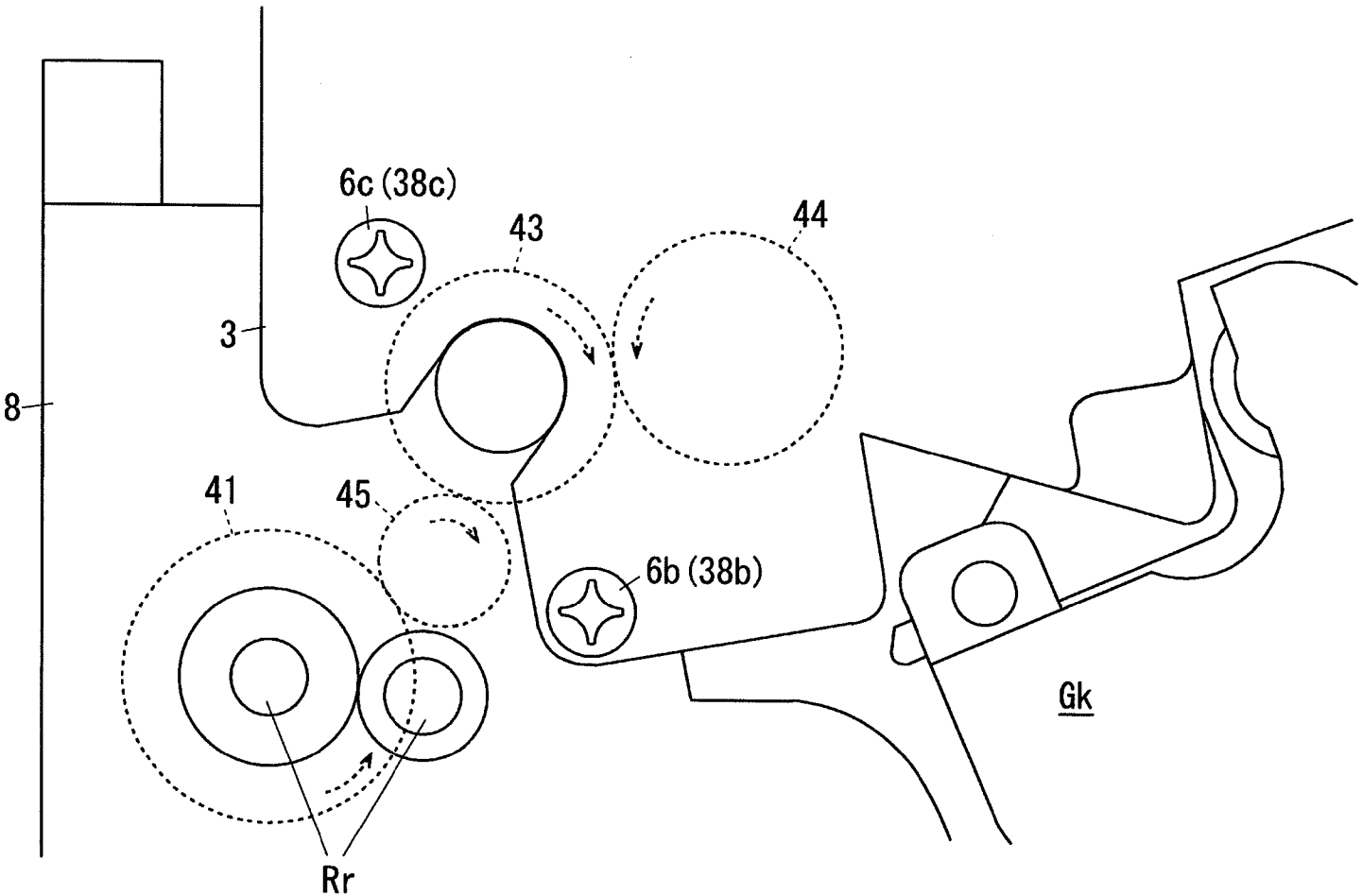
FIG. 8 illustrates an important part of a first fixing portion.
Figure 9:
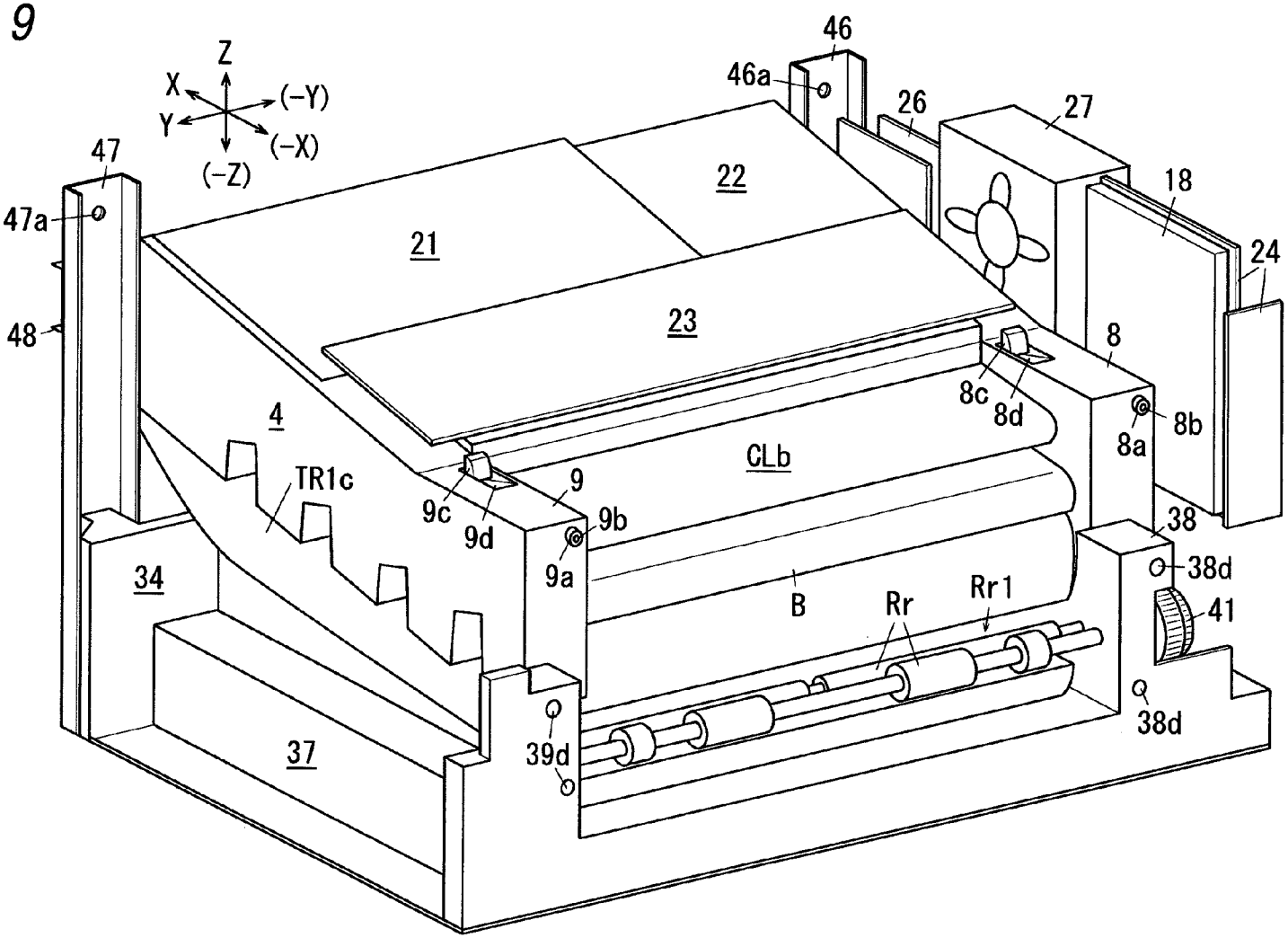
FIG. 9 is a perspective view, as viewed obliquely from a rear-right position, of the medium conveyance unit and the image recording unit which are connected together.
Figure 10:
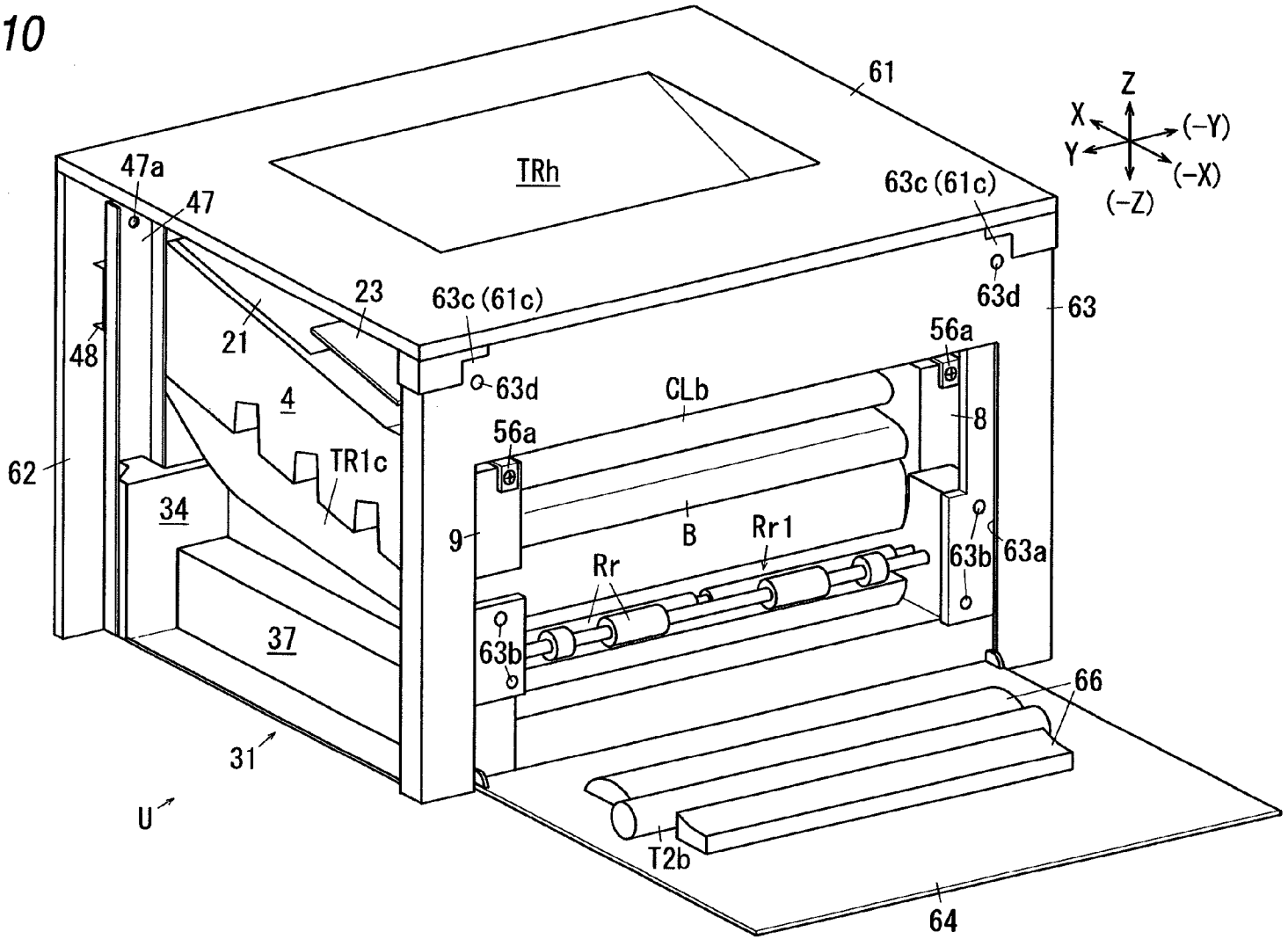
FIG. 10 is a perspective view, as viewed obliquely from a rear-right position, of an assembly including exterior members.
Figure 11:
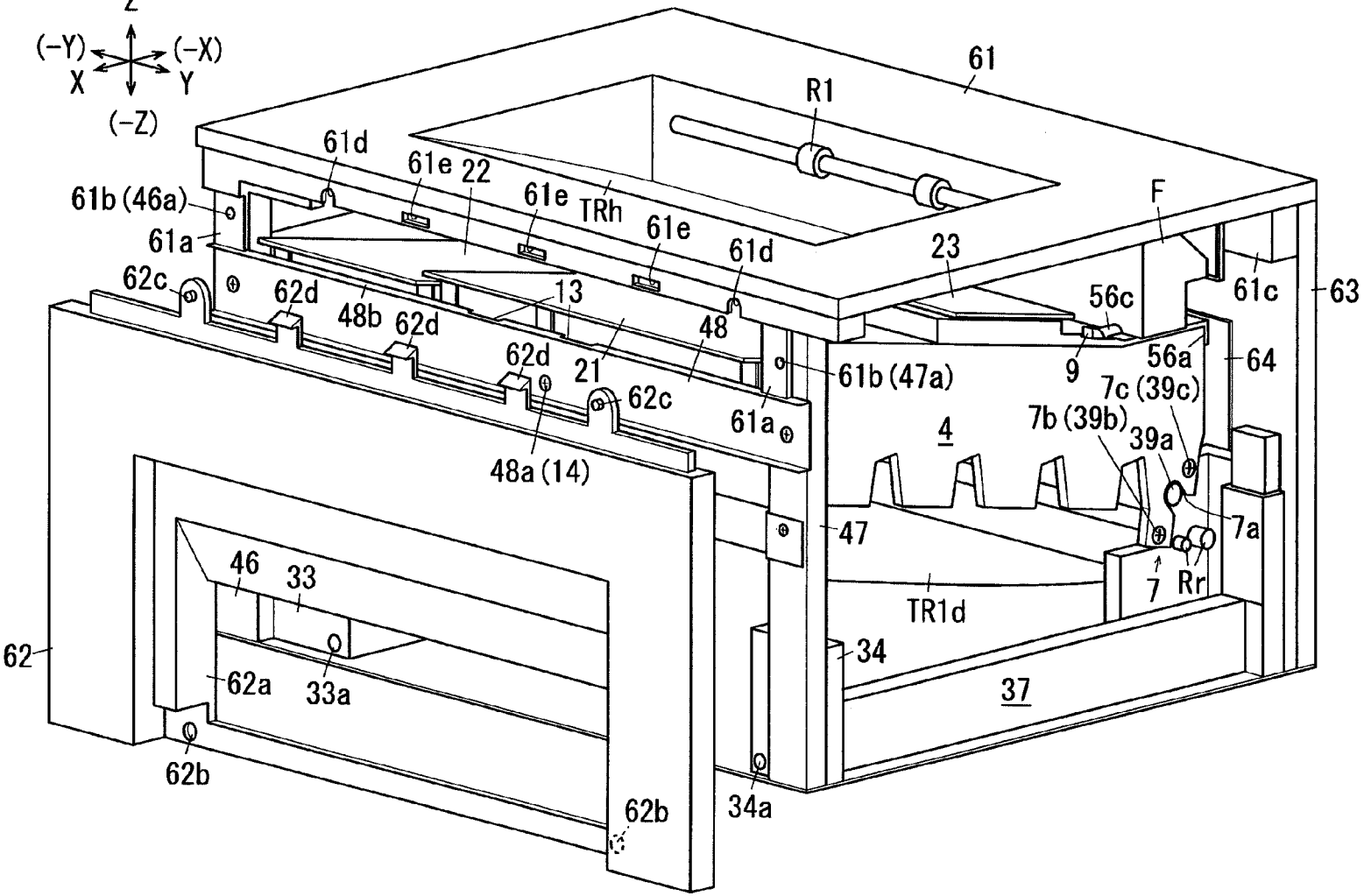
FIG. 11 is a perspective view, as viewed obliquely from a front-right position, of an assembly including the exterior members.

FIG. 2 shows an important part of a recording unit main body of an image recording unit of the first exemplary embodiment. FIG. 3 shows the recording unit main body of FIG. 2 and a drive unit attached to it. FIG. 4 shows the assembly of FIG. 3 and a circuit board and the like attached to it. FIGS. 5A and 5B are enlarged views of an important part including a fusing unit support portion; FIG. 5A illustrates an intermediate state of attachment of a support subject portion of a fusing unit to the fusing unit support portion and FIG. 5B illustrates a state that the attachment has been completed. FIG. 6 is a perspective view showing an important part of a medium conveyance unit (example second unit) of the exemplary embodiment. FIG. 7 shows a state that the medium conveyance unit and the image recording unit are connected to each other. FIG. 8 illustrates an important part of a first fixing portion. FIG. 9 is a perspective view, as viewed obliquely from a rear-right position, of the medium conveyance unit and the image recording unit which are connected together. FIG. 10 is a perspective view, as viewed obliquely from a rear-right position, of an assembly including exterior members. FIG. 11 is a perspective view, as viewed obliquely from a front-right position, of an assembly including the exterior members.

In the above drawings, to facilitate understanding and simplify the description, members that are not indispensable for the description may be omitted as appropriate. For example, the drive unit is omitted in FIG. 7 and the developing devices and the like are omitted in FIGS. 9-11.

(Image Recording Unit)

As shown in FIGS. 2-4, an image recording unit 1 (example first unit) of the first exemplary embodiment is equipped with a recording unit main body 2. As shown in FIG. 2, the recording unit main body 2 has a plate-like left end wall 3 and right end wall 4 (example side walls). The photoreceptor bodies Py-Pk, the backup roller T2*a* which supports the intermediate transfer belt B, the belt cleaner CLb, the charging rollers CRy-CRk, the charger cleaners CCy-CCk, photoreceptor body cleaners CLy-CLk, and the LED heads LHy-LHk are disposed between and supported by the left end wall 3 and the right end wall 4. The development devices Gy, Gm, Gc, and Gk of the respective colors, each of which is implemented as a unit, are also supported by the left end wall 3 and the right end wall 4 so as to occupy a bottom space between them.

A left fixing portion 6 (example first support portion) is formed as a bottom-rear portion of the left end wall 3; that is, the left fixing portion 6 is formed on the side of the outlet Rr1 below the backup roll T2*a*. In the left fixing portion 6, a U-shaped left positioning groove 6*a* (example first positioning portion) is formed so as to extend in a bottom-rear to top-front direction. Left screw passage holes 6*b* and 6*c* (example first fixing portions) which allow passage of a screw are formed on both sides of (below and above) the left positioning groove 6*a*.

As shown in FIG. 11, a right fixing portion 7 (example second support portion) is formed as a bottom-rear portion of the right end wall 4 in the same manner as the left fixing portion 6 on the side of the outlet Rr1. In the right fixing portion 7, a right positioning groove 7*a* (example second positioning portion) is formed and right screw passage holes 7*b* and 7*c* (example second fixing portions).

As shown in FIGS. 2 and 3, fusing unit support portions 8 and 9 (example third unit support portions) as top-rear portions of the end walls 3 and 4, respectively; that is, the fusing unit support portions 8 and 9 are provided above the backup roll T2*a*.

As shown in FIG. 2 and FIGS. 5A and 5B, the fusing unit support portions 8 and 9 has positioning/fixing portions 8*a* and 9*a* which project rearward from the rear surfaces of the end walls 3 and 4, respectively. Screw holes 8*b* and 9*b* are formed in the positioning/fixing portions 8*a* and 9*a*.

As shown in FIG. 2 and FIGS. 5A and 5B, the top surfaces of the fusing unit support portions 8 and 9 are formed with cylindrical fusing positioning portions 8*c* and 9*c* (example third unit positioning portions). Slant surfaces 8*d* and 9*d* which are inclined so as to become lower as the position goes forward and positioning bottom surfaces 8*e* and 9*e* which are formed under the fusing positioning portions 8*c* and 9*c* are formed adjacent to the fusing positioning portions 8*c* and 9*c*, respectively.

A high-voltage power board support portion 11 (example first board support portion) is supported by front portions of the fusing unit support portions 8 and 9. The high-voltage power board support portion 11 of the first exemplary embodiment has a housing space 11*a* where circuit elements used in a high-voltage power board are housed.

A plate-like control board support portion 12 (example second board support portion) is formed in front of the high-voltage power board support portion 11. Front positioning pieces 13 (example third positioning portions) project forward symmetrically from the front end of the control board support portion 12. A front screw hole 14 (example third fixing portion) is formed in the front wall of the recording unit main body 2 below the front positioning pieces 13.

A front fixing portion 13+14 (third support portion) of the first exemplary embodiment is formed by the front positioning pieces 13 and the front screw hole 14 on the opposite side to the outlet Rr1 of the image recording unit 1, that is, on the front side. Recording unit support portions 6+7+13+14 of the first exemplary embodiment are formed by the left fixing portion 6, the right fixing portion 7, and the front fixing portion 13+14.

In this specification, when a medium conveyance unit 31 (described later; a replenishment space cover U2 is closed) is divided in the horizontal direction into three parts, that is, a front portion, a central portion, and a rear portion, the terms "outlet side" and "opposite side to the outlet side" mean the sides corresponding to the rear portion and the front portion, respectively.

As shown in FIG. 3, a drive unit 16 is supported by the left-hand surface of the recording unit main body 2. The drive unit 16 (example drive source) is equipped with the drive roller Rd for driving the photoreceptor bodies Py-Pk and the intermediate transfer belt B and a drive motor 17 for driving the developing rollers G1*y*-G1*k* of the developing devices Gy-Gk and the like. Plural gears for transmitting drive power of the drive motor 17 to the photoreceptor bodies Py-Pk and a transmission system (not shown) having a clutch for controlling transmission/non-transmission of rotation are provided in the drive unit 16. A plate-like terminal board support portion 18 (example third board support portion) is supported by a rear portion of the drive unit 16 so as to extend in the top-bottom direction.

As shown in FIG. 4, a low-voltage power board 21 to which electric power is supplied from an external power source of the printer U via a harness (not shown) and which generates voltages to be supplied to the motor, sensors, and the like is supported by a right portion of the control board support portion 12. A control board 22 which is electrically connected to the low-voltage power board 21 and is provided with such circuits as the control circuit C and the image processing section GS is disposed on the left of the low-voltage power board 21 and supported by the control board support portion 12.

A high-voltage power board 23 which is electrically connected to the low-voltage board 21 and generates charging voltages to be applied to the charging rollers CRy-CRk, developing voltages to be applied to the developing rollers G1*y*-G1*k*, primary transfer voltages to be applied to the primary transfer rollers T1*y*-T1*k*, and other voltages is supported by the high voltage power board support portion 11. The circuits provided in the low-voltage power board 21 and the high-voltage power board 23 constitute the power circuit E of the first exemplary embodiment.

Terminal boards 24 which are electrically connected to the personal computer PC and performs input/output of image information, control signals, and the like are supported by the terminal board support portion 18. An additional board 26 which is electrically connected to the boards 21-24 is supported by a front portion of the left-hand surface of the drive unit 16.

A cooling fan 27 (example fan) is supported by the drive unit 16 so as to be located over the drive motor 17.

The members 2-4, 6-9, 11-14, 16-18, 21-24, and 26-27 constitute the image recording unit 1 of the first exemplary embodiment.

(Medium Conveyance Unit

As shown in FIGS. 6 and 7, the medium conveyance unit 31 has a bottom wall 32. A pair of (left and right) exterior fixing portions 33 and 34 are formed on a front portion of the bottom wall 32 so as to extend in the top-bottom direction. Exterior fixing bottom fixing screw holes 33*a* and 34*a* are formed in bottom portions of the exterior fixing portions 33 and 34, respectively. A left side wall 36 and a right side wall 37 which serve as left and right side walls of the sheet supply tray TR1 are formed behind the exterior fixing portions 33 and 34 so as to extend rearward.

A pair of (left and right) recording unit fixing portions 38 and 39 (example first unit fixing portions) are formed on a rear end portion of the bottom wall 32 so as to extend upward. In the left recording unit fixing portion 38 (example first support subject portion), a left positioning shaft 38*a* (example first positioning subject member) is disposed so as to correspond to the left positioning groove 6*a* and to extend leftward. Left screw holes 38*b* and 38*c* (example first fixing subject portions) are formed on both sides of (below and above) the left positioning shaft 38*a* so as to correspond to the respective screw passage holes 6*b* and 6*c*. As shown in FIG. 9, the rear surface of the left recording unit fixing portion 38 is formed with a pair of (top and bottom) rear screw holes 38*d* (example exterior fixing portions).

The right recording unit fixing portion 39 (example second support subject portion) is formed in the same manner as the left recording unit fixing portion 38. That is, in the right recording unit fixing portion 39, a right positioning shaft 39*a* (example second positioning subject member) is disposed so as to correspond to the right positioning groove 7*a* and to extend rightward. Right screw holes 39*b* and 39*c* (example second fixing subject portions) are formed so as to correspond to the respective screw passage holes 7*b* and 7*c*. As shown in FIG. 9, the rear surface of the right recording unit fixing portion 39 is formed with a pair of (top and bottom) rear screw holes 39*d* (example exterior fixing portions).

As shown in FIGS. 6 and 7, the registration rollers Rr are disposed between the recording unit fixing portions 38 and 39 and supported by them at positions close to the positioning shafts 38*a* and 39*a*. A registration roller gear 41 (example transmission subject gear) to which drive power is transmitted and which incorporates a clutch for controlling transmission/non-transmission of rotation is supported by the left end portion of the one registration roller Rr. The sheet feed roller Rp is supported so as to be located on the bottom-front side of the registration roller Rr, and a sheet feed roller gear 42 is supported by the left end portion of the sheet feed roller Rp.

As shown in FIG. 8, the registration roller gear 41 of the first exemplary embodiment is supported in such a manner that rotation can be transmitted to it via an intermediate gear 43 (example intermediate transmission member) which is supported rotatably by the left positioning shaft 38*a*. The intermediate gear 43 is in mesh with a gear 44 (example first rotation transmission member) to which drive power is transmitted from the drive motor 17 of the image recording unit 1 and a gear 45 (example second rotation transmission member) which is rotatably supported by the medium conveyance unit 31 and is in mesh with the registration roller gear 41. When the drive motor 17 is driven, the registration roller gear 41 is rotated via the gears 43-45.

A pair of (left and right) vertical guide members 46 and 47 is supported by the front surfaces of the exterior fixing portions 33 and 34 so as to extend upward. The bottom ends of the vertical guide members 46 and 47 of the first exemplary embodiment are supported by the top surface of the bottom wall 32. Top screw holes 46*a* and 47*a* (example exterior fixing portions) are formed in top end portions of the vertical guide members 46 and 47, respectively.

A horizontal guide member 48 (example third support subject portion) is supported by the vertical guide members 46 and 47 at positions located under the top screw holes 46*a* and 47*a* so as to extend in the right-left direction. The horizontal guide member 48 thus connects the vertical guide members 46 and 47. A front screw through-hole 48*a* (example third fixing subject portion) is formed in a central portion, in the right-left direction, of the horizontal guide member 48 so as to correspond to the front screw hole 14 of the image recording unit 1. A front positioning wall 48*b* (example third positioning subject portion) which is in contact with the front positioning pieces 13 is formed as a top wall of the horizontal guide member 48.

The top wall TR1*c* of the sheet supply tray TR1 is disposed over the bottom wall 32 and the front end of the top wall TR1*c* is supported by the vertical guide members 46 and 47.

The space enclosed by the bottom wall 32, the exterior fixing portions 33 and 34, the vertical guide members 46 and 47, and the horizontal guide member 48 is the replenishment space TR1*d* of the sheet supply tray TR1.

In the medium conveyance unit 31 of the first exemplary embodiment, the vertical guide members 46 and 47 and the horizontal guide member 48 constitute a wiring guide member (harness guide) 46-48 which guides signal transmission and power supply wires (harness) so that they are guided to the boards 21-24, 26 so as not to cross the replenishment space TR1*d*.

(Fusing Unit)

As shown in FIG. 7, the fusing unit 51 (example third unit) of the first exemplary embodiment is equipped with a fusing left wall 52 and a fusing right wall 53. The fusing device F and the ejection rollers Rh are disposed between and supported by the fusing left wall 52 and the fusing right wall 53.

As shown in FIG. 7, a fusing connection member 56 (example fusing support subject member) is supported by a bottom end portion of the fusing left wall 52 so as to extend in the front-rear direction. As shown in FIGS. 5A and 5B and FIG. 7, a rear end portion of the fusing connection member 56 is formed with a positioning/fixing subject portion 56*a* (example fusing fixing subject portion) which is bent downward so as to correspond to the positioning/fixing portion 8*a*. As shown in FIGS. 5A and 5B, a rear positioning hole 56*b* into and through which the positioning/fixing portion 8*a* is to fit and penetrate is formed in the positioning/fixing subject portion 56*a*.

As shown in FIGS. 5A and 5B and FIG. 7, a front end portion of the fusing connection member 56 is formed with a forked positioning subject portion 56*c* (example fusing positioning subject portion) which serves for positioning in the top-bottom direction when fitted with the fusing positioning portion 8*c*.

Like the left fusing connection member 56, a right fusing connection member 56 is supported by a bottom end portion of the fusing right wall 53 so as to correspond to the right fusing unit support portion 9.

(Exterior Members)

As shown in FIGS. 10 and 11, the printer U according to the first exemplary embodiment is equipped with a top cover 61, a front cover 62, and a rear cover 63 (example exterior members).

As shown in FIG. 11, the top cover 61 is formed with the ejection tray TRh. A front end portion of the top cover 61 is formed with a pair of (left and right) top fixing subject pieces 61*a* (example exterior fixing subject portions) for fixing of the front cover 62 to the units so as to extend downward and to correspond to the vertical guide members 46 and 47. Screw through-holes 61*b* are formed through the top fixing subject pieces 61*a* so as to correspond to the top screw holes 46*a* and 47*a* of the vertical guide members 46 and 47, respectively.

As shown in FIG. 11, a rear end portion of the top cover 61 is formed with a pair of (left and right) cover-to-cover fixing subject portions 61*c* (example exterior-to-exterior fixing subject portions) for fixing of the top cover 61 and the rear cover 63 to each other. Screw holes (not shown) are formed in the cover-to-cover fixing subject portions 61*c*.

As shown in FIG. 11, the front end portion of the top cover 61 is formed with a pair of (left and right) semicircular positioning recesses 61*d* (example exterior-to-exterior positioning subject portions). Three rectangular fixing holes 61*e* (example exterior-to-exterior fixing subject portions) are formed through the front end portion of the top cover 61 inside the positioning recesses 61*d* in the right-left direction so as to be spaced from each other in the right-left direction.

The front cover 62 has an opening 62*a* which corresponds to the replenishment space TR1*d*. Two (left and right) screw passage holes 62*b* (example exterior fixing subject portions) are formed through the front cover 62 at bottom positions that are located on the left of and on the right of the opening 62*a* so as to correspond to the bottom fixing screw holes 33*a* and 34*a* of the medium conveyance unit 31, respectively. As shown in FIG. 11, a pair of (left and right) cylindrical positioning projections 62*c* (example exterior-to-exterior positioning subject portions) project forward from a top end portion of the front cover 62 at such positions as to correspond to the respective positioning recesses 61*d*. Fixing nails 62*d* (example exterior-to-exterior fixing subject portions) are formed inside the positioning projections 62*c* in the right-left direction at such positions as to correspond to the respective fixing holes 61*e*.

The replenishment space cover U2 is supported rotatably by the front cover 62.

An opening 63*a* for an opening/closing door is formed through the rear cover 63 in a central portion. Four rear screw passage holes 63*b* (example exterior fixing subject portion) on both sides of the opening 63*a* in the right-left direction at such positions as to correspond to the four rear screw holes 38*d* and 39*d*. A top end portion of the rear cover 63 is formed with cover-to-cover fixing portions 63*c* (example exterior-to-exterior fixing portions) which are opposed to the rear surfaces of the cover-to-cover fixing subject portions 61*c*, respectively. Screw through-holes 63*d* are formed through the cover-to-cover fixing portions 63*c* so as to correspond to the screw holes of the cover-to-cover fixing subject portions 61*c*, respectively.

An opening/closing door 64 (example opening/closing member) is supported by the rear cover 63 so as to fit in the opening 63*a*. A bottom end portion of the opening/closing door 64 is rotatably supported by the exterior fixing portions 33 and 34 of the medium conveyance unit 31. The secondary transfer roller T2*b* and rear guide members 66 of the medium conveyance path SH are supported by the inside surface of the opening/closing door 64.

(Fixing of Units and Members)

(Fixing of Image Recording Unit to Medium Conveyance Unit)

As shown in FIGS. 3, 6, 7, 8, and 11, to cause the image recording unit 1 to be supported by the medium conveyance unit 31, the positioning grooves 6*a* and 7*a* are fitted into the respective positioning shafts 38*a* and 39*a*, whereby the positioning grooves 6*a* and 7*a* are positioned and the image recording unit 1 is supported so as to be rotatable about the positioning shafts 38*a* and 39*a*. Then, the image recording unit 1 is rotated until the front positioning pieces 13 come into contact with the front positioning wall 48*b*, whereby the front side of the image recording unit 1 is positioned. In this state, the rear-left end portion of the image recording unit 1 is fixed to the recording unit fixing portion 38 from the left side by inserting screws into the screw holes 38*b* and 38*c* through the left screw passage holes 6*b* and 6*c*. Likewise, the rear-right end portion of the image recording unit 1 is fixed to the recording unit fixing portion 39 from the right side by inserting screws into the screw holes 39*b* and 39*c* through the right screw passage holes 7*b* and 7*c*. And the front end portion of the image recording unit 1 is fixed to the horizontal guide member 48 from the front side by inserting a screw into the front screw hole 14 through the front screw through-hole 48*a*. That is, in the first exemplary embodiment, each of the left and right fixing portions 6 and 7 and the front fixing portion 13+14 (third support portion) has a horizontal fastening structure. As a result, the image recording unit 1 is fixed to the medium conveyance unit 31 in such a manner as to be positioned at the three locations, that is, the recording unit fixing portions 38 and 39 and the horizontal guide member 48.

As such, the image recording unit 1 is supported by the medium conveyance unit 31 in such a manner that it cannot be detached by a user who uses media (recording sheets S). The term "user who uses media" means a person who prints out data in an office, a store, a lounge in an airport or a hotel, a home, or the like and does not include a service person who inspect or repair the image forming apparatus when trouble occurs there or a worker who inspect or repair the image forming apparatus in a warehouse or a factory. Non-users such as a service person or a worker can detach the image recording unit 1 from the medium conveyance unit 31 using tools or the like.

The recording unit fixing portions 38 and 39 and the horizontal guide member 48 constitute a recording unit support subject portion 38+39+48 of the first exemplary embodiment.

(Fixing of Fusing Unit to Image Recording Unit)

As shown in FIGS. 5A and 5B and FIG. 7, to cause the fusing unit 51 to be supported by the image recording unit 1, the forked positioning subject portions 56*c* of the fusing unit 51 are fitted with the respective fusing positioning portions 8*c* and 9*c* while being guided by the slant surfaces 8*d* and 9*d* and the positioning bottom surfaces 8*e* and 9*e* of the image recording unit 1, respectively (see FIG. 5A). Because the fusing positioning portions 8*c* and 9*c* are fitted in the positioning subject portions 56*c*, the fusing unit 51 is supported by the image recording unit 1 in such a manner as to be movable in the front-rear direction. The fusing unit 51 is positioned when it has moved to such a position that positioning/fixing portions 8*a* and 9*a* are fitted with the rear positioning holes 56*b* of the positioning/fixing subject portions 56*a* of the fusing unit 51. The fusing unit 51 is fixed to the image recording unit 1 by inserting screws into the screw holes 8*b* and 9*b* of the fusing unit support portions 8 and 9.

(Fixing of Exterior Covers)

As shown in FIGS. 10 and 11, the front end portion of the top cover 61 is fixed to the vertical guide members 46 and 47 by inserting screws into the top screw holes 46*a* and 47*a* of the vertical guide members 46 and 47 through the screw through-holes 61*b* of the top fixing subject pieces 61*a*, respectively. The rear end portion of the top cover 61 is fixed to the rear cover 63 by inserting screws into the screw holes (not shown) of the cover-to-cover fixing subject portions 61*c* through the screw through-holes 63*d* of the cover-to-cover fixing portions 63*c* of the rear cover 63.

The front cover 62 is positioned when the positioning projections 62*c* fit into the respective positioning recesses 61*d* in a state that the top flange of the front cover 62 is inserted to inside the front flange of the top cover 61. The fixing nails 62*d* are hooked on the respective fixing holes 61*e* of the top cover 61. The front end portion of the top cover 61 is thus fixed to the front cover 62. The bottom portion of the front cover 62 is fixed to the medium conveyance unit 31 by inserting screws into the bottom fixing screw holes 33*a* and 34*a* of the medium conveyance unit 31 through the screw passage holes 62*b*, respectively.

The rear cover 63 is fixed to the medium conveyance unit 31 by inserting screws into the rear screw holes 38*d* of the medium conveyance unit 31 through the rear screw passages holes 63*b*, respectively.

Therefore, the top cover 61, the front cover 62, and the rear cover 63 are not fixed to the image recording unit 1 or the fusing unit 51 but to the medium conveyance unit 31. Left and right side covers (not shown) of the first exemplary embodiment are supported by the covers 61-63 or the bottom wall 32.

(Workings of First Exemplary Embodiment)

In the above-configured printer U according to the first exemplary embodiment, the image recording unit 1 is fixed to the medium conveyance unit 31 in a state that the former is directly positioned with respect to the latter. And the fusing unit 51 is fixed to the image recording unit 1 in a state that the former is positioned with respect to the latter. That is, the medium conveyance unit 31 and the fusing unit 51 can be regarded as being fixed to the image recording unit 1 in a state that the former are positioned with respect to the latter. Therefore, unlike conventional, common printers using frames, the printer U according the first exemplary embodiment has a frameless structure. Unlike in conventional printers in which no direct positioning is made between the units and positioning is done via the frames, the printer U is free of accumulated errors of manufacturing errors, attachment errors, and the like of the individual members which would be caused by intervention of frames. Therefore, positional deviations between toner images of the respective colors, a positional deviation between toner images and a recording sheet S, and the like are reduced and the image quality is thus increased. Furthermore, because no frames are used, the size, weight, and cost can be made smaller or lower than in conventional configurations having frames.

In the printer U according to the first exemplary embodiment, the image recording unit 1 is fixed to the medium conveyance unit 31 at the three locations, that is, the center, in the right-left direction, of the front end portion, the rear-left end portion, and the rear-right end portion. In the first exemplary embodiment, stated more accurately, in the rear end portions, the image recording unit 1 is fixed to the medium conveyance unit 31 at the four locations (left and right screw passage holes 6*b*, 6*c*, 7*b*, and 7*c*). However, since the screw passage holes 6*b* and 6*c* are close to each other and the screw passage holes 7*b* and 7*c* are also close to each other, these locations can virtually be regarded as two locations from the viewpoint of the entire image recording unit 1.

Where the image recording unit 1 is fixed at four locations, if distortion occurs in the medium conveyance unit 31, the image recording unit 1 fixed to it is distorted, as a result of which positional deviations may occur between toner images of Y, M, C, and K or between a recording sheet S and toner images that are transferred to it at the secondary transfer region Q5. In contrast, in the first exemplary embodiment, by virtue of the fixing at the three locations, distortion of the medium conveyance unit 31 less likely affects the image recording unit 1. That is, adverse effects of distortion such as positional deviations between toner images are less likely to occur than in the case of fixing at four or more locations.

In particular, the intermediate transfer belt B (endless belt) of the image recording unit 1 may be shifted to one side or snake if distortion occurs in the image recording unit 1. However, the degrees of a shift to one side of the intermediate transfer belt B are low because the image recording unit 1 of the first exemplary embodiment is less affected by distortion of the medium conveyance unit 31 than in conventional configurations.

Figure 12A:
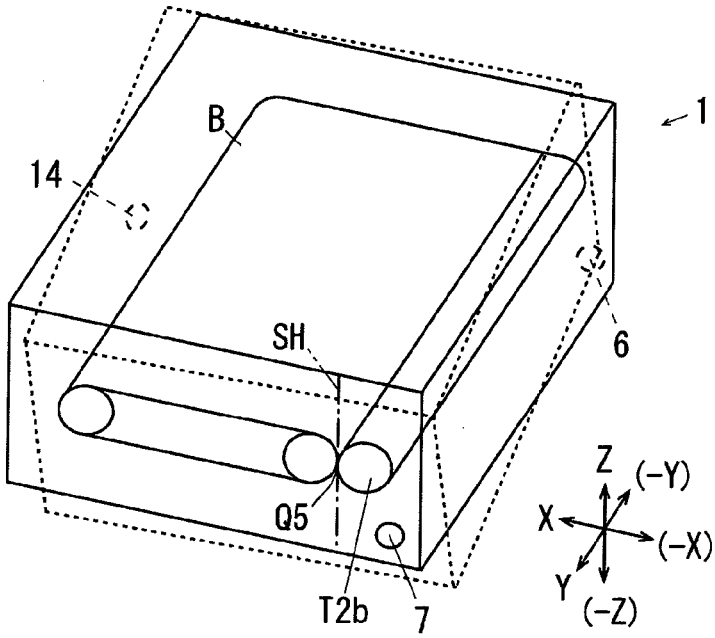
FIGS. 12A and 12B illustrate influences of distortion of the image recording unit in the case of the first exemplary embodiment in which an image recording region is located on a two-point support side (sheet outlet side) and in a conventional case in which an image recording region is located at a position that is away from a two-point support side and a sheet outlet side, respectively.
Figure 12B:
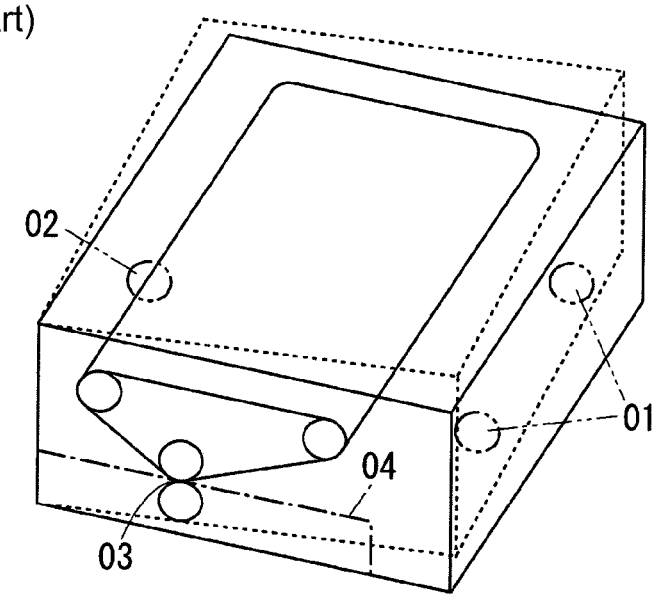
FIG. 12B (Related Art)

FIGS. 12A and 12B illustrate influences of distortion of the image recording unit 1 in the case of the first exemplary embodiment in which the image recording region is located on the two-point support side (sheet outlet side) and in the conventional case in which the image recording region is located at a position that is away from the two-point support side and the sheet outlet side, respectively.

In the first exemplary embodiment, the image recording unit 1 is fixed to the medium conveyance unit 31 at the two locations (left and right locations) on the rear side (the side of the outlet Rr1) through which a recording sheet S is output from the medium conveyance unit 31 to the image recording unit 1. That is, in the first exemplary embodiment, image recording unit 1 is supported by the medium conveyance unit 31 at the two locations on the rear side (supported at the three locations in total).

As shown in FIG. 12A, in the printer U according to the first exemplary embodiment in which the transfer region Q5 (image recording region) is located on the side of the outlet Rr1, when distortion occurs in the medium conveyance unit 31 due to undulation or the like of the surface on which the printer U is installed, the side of the transfer region Q5 is distorted in link with distortion of the outlet Rr1 and a relative positional deviation between a recording sheet S conveyed from the outlet Rr1 and toner images transferred to it at the transfer region Q5 is small.

On the other hand, as shown in FIG. 12B, in the conventional configuration in which an image recording region 03 is located at a position that is away from two-point support portions 01 and a one-point support portion 02, when distortion occurs in the lower unit, distortion occurring in the support portions 01 is linked with distortion occurring in the support portion 02 but distortion occurring in the image recording region 03 does not coincide with the above distortion to cause a positional deviation (indicated by broken lines in FIG. 12B). As a result, the distortion varies along a conveyance path 04 (indicated by a chain line) and an input recording sheet S tends to travel obliquely as it is conveyed to the image recording region 03. A positional deviation likely occurs between toner images and the recording sheet S which travels obliquely, that is, skews. Even if a configuration capable of correcting a skew of a recording sheet S with registration rollers located upstream of the image recording region 03, the skew may not be corrected sufficiently or another skew may be produced between the skew correction and the transfer by distortion existing from the registration rollers to the image recording region 03 to cause a positional deviation between toner images and the recording sheet S. In contrast, in the first exemplary embodiment, the difference between distortion of the outlet Rr1 and distortion at the transfer region Q5 is relatively smaller than in the conventional configuration, as a result of which a positional deviation of toner images is small and the image quality is increased.

In the image recording unit 1 of the first exemplary embodiment, not only the photoreceptor bodies Py-Pk and the intermediate transfer belt B but also the LED heads LHy-LHk are supported by the left and right end walls 3 and 4; they behave in the same manner to distortion of the image recording unit 1. Therefore, a relative positional deviation between toner images and a recording sheet S is smaller and image quality degradation is lower than in a configuration in which the latent image forming device is located outside the image recording unit.

Furthermore, in the first exemplary embodiment, the image recording unit 1 is screwed in the horizontal direction rather than in the vertical direction, that is, in such a direction that a twist is caused less likely. More specifically, as shown in FIG. 12A, when the left fixing portion 6 and the right fixing portion 7 are distorted in the vertical direction due to distortion of the medium conveyance unit 31 that is caused by undulation of the installation surface of the printer U, on the front side rotation occurs about the front screw hole 14; the front fixing portion 13+14 can be distorted by approximately the same amount as the distortion amount of the left fixing portion 6 or the right fixing portion 7 of the image recording unit 1. In particular, the direction of the rotation center when the image recording unit 1 is inclined coincides with the direction of the tip of the fastening member such as a screw and hence the image recording unit 1 can rotate about the screw. If the tip of the fastening member such as a screw were directed downward, the front fixing portion 13+14 would obstruct inclining of the image recording unit 1. In contrast, in the first exemplary embodiment, such obstruction occurs less likely by virtue of the fixing in the horizontal direction. As a result, in the image recording unit 1 of the first exemplary embodiment, a twist occurs less likely and a positional deviation between a recording sheet S and toner images recorded thereon can be reduced.

In the printer U according to the exemplary embodiment, the fusing unit 51 is supported so as to be disposed over the transfer region Q5 and the position of the fusing region Q6 is determined and fixed on the side of the outlet Rrl. Therefore, when distortion occurs in the medium conveyance unit 31, the fusing unit 51 also tends to be distorted in link with it. Therefore, a relative positional deviation between the fusing region Q6 and a recording sheet S or the like is made small. The probability of occurrence of a fusing failure, a jam of a recording sheet S due to a skew, and the like is lower than in conventional configurations.

In the printer U according to the exemplary embodiment, the exterior covers such as the top cover 61, the front cover 62, the rear cover 63, and the opening/closing door 64 are not fixed to the image recording unit 1 or the fusing unit 51; they are fixed to and supported by the medium conveyance unit 31. In conventional configurations using frames, exterior covers are attached to the frames and hence external force does not directly act on the image recording unit. On the other hand, in the configuration of the first exemplary embodiment which does not use frames, if the exterior covers 61-64 were attached to the image recording unit 1, external force would directly act on the image recording unit 1 and the image forming members might be deviated. In view of this, in the first exemplary embodiment, the exterior covers 62-64 are attached to the medium conveyance unit 31 and the top cover 61 is fixed to the exterior covers 62 and 63 by means of the cover-to-cover fixing portions 63*c*, the cover-to-cover fixing subject portions 61*c*, the positioning projections 62*c*, the positioning recesses 61*d*, the fixing holes 61*e*, and the fixing nails 62*d*.

In the first exemplary embodiment, the exterior covers 61-64 are fixed without being fixed to the image recording unit 1 and sufficient rigidity of the covers 61-64 is thus secured as a whole. Therefore, though the frameless structure is employed, impact on an exterior member or distortion of an exterior member is prevented from being transmitted to the image recording unit 1. As a result, in the first exemplary embodiment, adverse influence, on the image recording unit 1, of external force or the like acting on any of the exterior covers 61-64 is reduced. The probability of occurrence of distortion in the image recording unit 1, a shift to one side of the intermediate transfer belt B, and the like is thus lowered.

Figure 13:
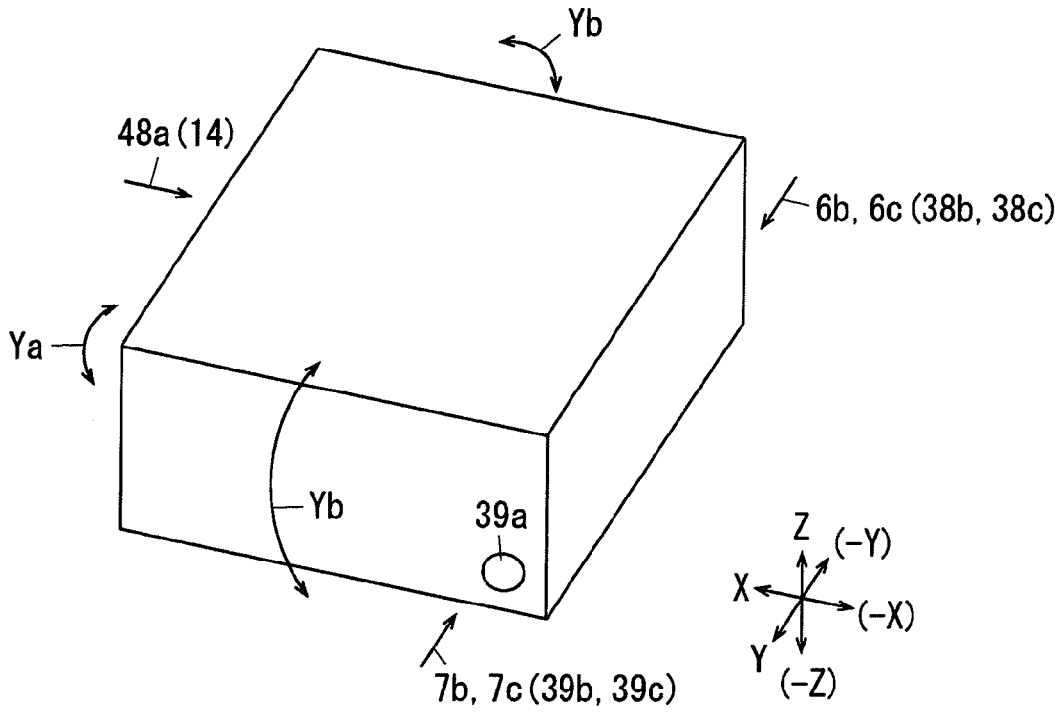
FIG. 13 illustrates a relationship between the fixing direction of the image recording unit of the first exemplary embodiment and the allowable distortion.

FIG. 13 illustrates a relationship between the fixing direction of the image recording unit 1 of the first exemplary embodiment and the allowable distortion.

In the printer U according to the first exemplary embodiment, the image recording unit 1 is supported by the medium conveyance unit 31 so as to be rotatable in the rotation direction indicated by arrow Ya in FIG. 13 about the positioning axis 38*a*/39*a*. Therefore, the image recording unit 1 can be positioned more easily with respect to the third support portion than in a case that it is not rotatable.

The image recording unit 1 is fixed from the left side or the right side on the rear side and is fixed from the front side on the front side. Therefore, a tool such as a driver can be inserted more easily in fastening a screw and hence assembling work can be done more easily than in a configuration in which screwing is performed from above or below. It is not necessary to form passages or holes through which to insert a driver or the like and to secure spaces for such passages or the like, which contributes to size reduction. Furthermore, a positional deviation of toner images due to deformation of the horizontal guide member 48 which is fixed to the vertical guide members 46 and 47 from the front side can be prevented more reliably than in a case that screwing is done from above.

The image recording unit 1 is fixed to the medium conveyance unit 31 from the left side or right side on the rear side (two-point support side) and from the front side rather than from the left side or right side on the front side (one-point support side). Therefore, unlike in a configuration in which the image recording unit 1 is fixed from the left side or right side on the one-point support side, distortion in the rotation direction indicated by arrow Yb in FIG. 13 can occur in each of the front-left portion and the front-right portion of the image recording unit 1. Therefore, the probability of occurrence of a shift to one side and snaking of the intermediate transfer belt B can be lowered. More specifically, where the image recording unit 1 is fixed from the left side or right side in the front end portion in which case the left-side portion or the right-side portion of the image recording unit 1 is bound, distortion indicated by arrow Yb is not permitted on the right side or left side and hence the image recording unit 1 is distorted according to distortion of the medium conveyance unit 31. The probability of occurrence of a resulting shift to one side and snaking of the intermediate transfer belt B cannot be lowered.

In the image recording unit 1 of the first exemplary embodiment, the intermediate gear 43 is supported by the positioning shaft 38*a* which is fixed by inserting screws into the screw holes 38*b* and 38*c* which are located below and above the positioning shaft 38*a*. The positioning shaft 38*a* also serves as the rotation center of the image recording unit 1. In general, when gears are engaged with each other and rotated, forces act on the gears in such directions as to separate them from each other as counterforces (drive counterforces) of the engagement. If the intermediate gear 43 were disposed at a different position than the positioning shaft 38*a*, the image recording unit 1 would receive force in such a direction as to be separated from the medium conveyance unit 31, that is, to be lifted up, and the image recording unit 1 might be distorted or the position of the transfer region Q5 might be deviated. In contrast, in the first exemplary embodiment, since the intermediate gear 43 is supported by the positioning shaft 38*a* and fixed by means of the nearby screw holes 38*b* and 38*c*, the image recording unit 1 is less prone to receive adverse effects such as distortion even when counterforce of engagement acts on it.

(Modifications)

Example modifications (H01)-(H09) to the exemplary embodiment will be described below.

(H01) Although the exemplary embodiment is directed to the printer which is an example image forming apparatus, the invention is not limited to such a case and can be applied to a copier, a facsimile machine, a multifunction apparatus having all or plural ones of the printing, copying, and facsimile functions, and other apparatus. The application fields of the invention are not limited to electrophotographic image forming apparatus and encompass image forming apparatus of other image recording methods such as the inkjet recording method and the thermal transfer method.

(H02) Although the printer U according to the exemplary embodiment employs developers of the four colors, the invention is not limited to such a case and can be applied to a single-color image forming apparatus and a multi-color image forming apparatus of five or more colors or three or less colors.

(H03) Although in the exemplary embodiment the image recording unit 1 is rotatable about the positioning shafts 38*a* and 39*a*, the invention is not limited to such a case. A configuration in possible in which the image recording unit 1 is supported so as not to be rotatable (e.g., it is supported from below). The structures involving the positioning shafts 38*a* and 39*a* are not limited to the illustrated ones. For example, the positioning shafts 38*a* and 39*a* may also serve as the rotation axes of the registration rollers Rr. In this case, the positioning accuracy of the image recording unit 1 with respect to the registration rollers Rr is increased further and a positional deviation between a recording sheet S being conveyed and the secondary transfer region Q5 is reduced further. However, since the registration roller gear 41, a registration sensor (not shown), and the like are disposed in the vicinity of the rotation axes of the registration rollers Rr, to use the positioning shafts 38*a* and 39*a* also as the rotation axes of the registration rollers Rr, it may be necessary to elongate the rotation axes of the registration rollers Rr in the axial direction, which may increase the size of the printer U. It is therefore desirable to use the positioning shafts 38*a* and 39*a* also as the rotation axes of the registration rollers Rr only when it is possible in connection with an allowable size of the printer U and the positional relationships with such components as the gear 41.

(H04) Although in the exemplary embodiment the fusing unit 51 is disposed above the image recording unit 1, the invention is not limited to such a case. A configuration is possible in which the fusing unit 51 is incorporated in the image recording unit 1 or supported by the medium conveyance unit 31.

(H05) Although in the exemplary embodiment the exterior covers 61-64 are not fixed to the image recording unit 1 or the fusing unit 51, the invention is not limited to such a case. The exterior covers 61-64 may be fixed to the image recording unit 1, for example.

(H06) Although it is desirable that the front portion of the image recording unit 1 be fixed from the front side (exemplary embodiment) or from above or below in the vertical direction (e.g., from above using the positioning pieces 13), the invention is not limited to such a case. The image recording unit 1 may be fixed from the left side or the right side.

(H07) Although in the exemplary embodiment the registration rollers Rr are provided in the medium conveyance unit 31, the invention is not limited to such a case. For example, the registration rollers Rr may be incorporated in the image recording unit 1. In this case, a sheet outlet of a conveying member that is located upstream of the registration rollers Rr serves as an outlet from the medium conveyance unit 31 to the image recording unit 1. It is likewise possible to incorporate the secondary transfer roller T2*b* in the image recording unit 1.

(H08) Although in the exemplary embodiment the intermediate gear 44 is rotatably supported by the positioning shaft 38*a*, the invention is not limited to such a case. The intermediate gear 44 may be supported by a member other than the positioning shaft 38*a*.

(H09) Although the exemplary embodiment employs screwing as a method for fixing and a mechanism for fastening the units 1, 31, and 51, the invention is not limited to such a case. For example, other fixing methods and fastening mechanisms such as snap fitting and riveting may be employed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a medium conveyance unit that includes medium conveying members which convey a medium on which an image is to be recorded, and an outlet from which the medium is output;

an image recording unit that includes an image recording device which records the image on the medium conveyed from the medium conveyance unit at an image recording region which is located on a side of the outlet; and recording unit support portions that have a first support portion and a second support portion which are disposed in the image recording unit on the side of the outlet and are spaced from each other in a width direction of the medium conveyed, and a third support portion which is disposed in the image recording unit on an opposite side to the outlet, wherein at least the first support portion and the second support portion are supported on the side of the outlet of the medium conveyance unit, and the image recording unit is supported by the medium conveyance unit in an undetachable manner for a user who uses the image forming apparatus.

2. The image forming apparatus according to claim 1, wherein the medium conveying members include a timing adjusting member which adjusts timing of sending the medium to the image recording region.

3. The image forming apparatus according to claim 1, wherein the image recording unit further comprises:

an image holding body that is rotated while holding the image on a surface thereof;

an intermediate transfer body that is an endless belt, to which the image is transferred from the surface of the image holding body, and from which the image is transferred to the medium at the image recording region; and a primary transfer device that transfers the image from the image holding body to the intermediate transfer body.

4. The image forming apparatus according to claim 3, wherein the image recording unit has side walls which support the image holding body, the intermediate transfer body, and a latent image forming device for forming a latent image on the image holding body.

5. The image forming apparatus according to claim 3, further comprising:

a fusing unit that has a fusing device fusing the image transferred to the medium; and fusing unit support portions that are disposed on the side of the image recording region in the image recording unit and supports the fusing unit.

6. The image forming apparatus according to claim 1, further comprising:

a positioning member that is disposed on the side of the outlet of the medium conveyance unit and positions and supports in a rotatable manner, the image recording unit.

7. The image forming apparatus according to claim 6, further comprising:

a first rotation transmission member that is supported by the image recording unit;

a second rotation transmission member that is supported by the medium conveyance unit; and an intermediate transmission member that is supported by the positioning member and that is engaged with the first rotation transmission member and the second rotation transmission member, wherein the intermediate transmission member transmits rotation from the first rotation transmission member to the second rotation transmission member.

8. The image forming apparatus according to claim 1, wherein the third support portion is disposed approximately at the center, in a width direction of the medium, of the image recording unit.

9. The image forming apparatus according to claim 8, wherein the third support portion has a fastening structure which is fastened from a horizontal direction of the image recording unit.

10. The image forming apparatus according to claim 1, further comprising:

an exterior member that is supported by the medium conveyance unit, wherein the exterior member constitutes external surfaces of the image forming apparatus.

11. The image forming apparatus according to claim 10, wherein the exterior member is plural exterior members which have exterior-to-exterior fixing portions which fix the plural exterior members to each other.

* * * * *